United States Patent [19]

Fujita et al.

[11] 4,064,304

[45] Dec. 20, 1977

[54] COATED SYNTHETIC PAPER ADAPTED FOR OFFSET PRINTING AND METHOD FOR PRODUCTION THEREOF

[75] Inventors: Seigoro Fujita, Amagasaki; Tojiro Kitahori, Kawanishi, both of Japan

[73] Assignees: Kanzaki Paper Manufacturing Company, Ltd.; Toray Industries, Inc., both of Tokyo, Japan

[21] Appl. No.: 705,169

[22] Filed: July 14, 1976

Related U.S. Application Data

[63] Continuation of Ser. No. 480,548, June 17, 1974, abandoned.

[30] Foreign Application Priority Data

June 18, 1973 Japan ..... 48-67849

[51] Int. Cl.[2] ..... D21H 1/28; D21H 1/34; D21H 5/12

[52] U.S. Cl. ..... 428/207; 162/135; 162/146; 162/157 R; 162/164 R; 162/168 R; 162/168 N; 162/169; 162/181 R; 162/184; 427/39 DR; 427/391; 428/306; 428/342; 428/511; 428/518

[58] Field of Search ..... 162/135, 146, 157 R, 162/164 R, 164 EP, 168 R, 168 N, 169, 181 R, 181 A, 181 B, 181 C, 181 D, 183, 184; 427/245, 387, 391, 392, 385 R, 390 R, 288; 428/304, 306, 342, 500, 507, 511, 515, 518, 535, 537, 207

[56] References Cited

U.S. PATENT DOCUMENTS

| | | | |
|---|---|---|---|
| 3,017,295 | 1/1962 | Outterson et al. | 162/135 X |
| 3,081,519 | 3/1963 | Blades et al. | 162/157 RX |
| 3,228,790 | 1/1966 | Sexsmith et al. | 162/146 X |
| 3,808,091 | 4/1974 | Aoki et al. | 162/157 R |
| 3,897,300 | 7/1975 | Kohne et al. | 162/169 |

FOREIGN PATENT DOCUMENTS

| | | | |
|---|---|---|---|
| 873,682 | 7/1961 | United Kingdom | 162/135 |

*Primary Examiner*—Arthur L. Corbin
*Attorney, Agent, or Firm*—Cushman, Darby & Cushman

[57] ABSTRACT

A coated synthetic paper adapted for offset printing is produced from a base paper sheet comprising fibrous material, at least 5% by weight of which is formed of polyolefinic pulp fibrils which are formed from a polyolefinic polymer and a hydrophilic polymer, said polyolefinic pulp fibrils having a specific surface area of at least 0.7 square meter/g. A microporous and discontinuous coating layer is formed on at least one of the surfaces of the base paper sheet using a coating composition having an adhesive component and a pigment component, at least 5% by weight of said pigment component being an organic polymer pigment in the form of finely divided particles.

16 Claims, No Drawings

COATED SYNTHETIC PAPER ADAPTED FOR OFFSET PRINTING AND METHOD FOR PRODUCTION THEREOF

This is a continuation of application Ser. No. 480,548 filed June 17, 1974, now abandoned.

BACKGROUND OF THE INVENTION

This invention relates to an improved coated synthetic paper and the method of making the same. More particularly, this invention relates to an improved coated synthetic paper formed of polyolefinic synthetic pulp having on its surface a coating layer adapted for offset printing.

Polyolefin synthetic pulp is advantageous and superior in that it has a good heat sealability, higher strengths both in dry and wet conditions and a good dimensional stability which can never be obtained with natural cellulose pulp. Some attempts have been made to provide a pigment coated synthetic paper in which these advantages of the polyolefin synthetic pulp are utilized. For example, Japanese Pat. Publication No. 29,607 of 1972 (open to inspection) discloses a coated synthetic paper having a coating layer formed of inorganic pigments such as clay, calcium carbonate, satin white talc and the like, and adhesives such as casein, starch, styrenebutadiene latex and the like on a base paper formed either solely of polyolefin synthetic pulp or of a mixture of polyolefin synthetic pulp with natural cellulose pulp and/or another synthetic pulp. However, such coated synthetic paper like this is disadvantageous in that ink transfer cannot properly be made especially in case of the multi-color offset printing. Generally, in the multi-color offset printing, the fountain solution remains on the surface of the sheet during the printing process if the surface of the coated paper is poor in absorbing the fountain solution. The existence of the fountain solution on the surface of the paper causes to prevent the receipt by the paper of the ink to be transferred from a blanket cylinder to the paper surface. That is, when an aqueous coating composition consisting essentially of a pigment component and an adhesive component is applied onto the base paper formed of polyolefinic synthetic pulp and the coated paper is then dried, the above-mentioned coating composition penetrates into the base paper more slowly than in case of the base sheet formed of natural cellulose pulp. Therefore, the adhesive contained in the coating composition migrates toward the surface of the coated layer of the sheet in the process of drying, and the adhesive in the resultant coating layer is distributed more densely near the surface. This would be the reason why the coated synthetic paper is not good in the absorption of the fountain solution. Even if the amount of the polyolefinic pulp used is relatively small, the failure of absorption of the fountain solution occurs locally. If the amount of the polyolefinic pulp used is relatively large, the failure of absorption of the fountain solution occurs substantially over the whole surface of the paper.

On the other hand, in view of convenience of handling and reduction of cost of mailing and shipping it is desired to reduce the weight of the pigment coated paper. If the thickness of a base paper is reduced for this purpose, then it will result in deterioration of the strength, the brightness and the opacity of the paper. It has been hardly possible to avoid the above-mentioned disadvantages with use of the conventional natural cellulose paper having a pigment coating thereon.

The primary object of this invention is to provide an improved coated synthetic paper adapted for offset printing.

Another object of this invention is to provide an improved coated synthetic paper having a high opacity, good brightness and good dimensional stability.

A further object of this invention is to provide an improved coated synthetic paper which is relatively light but stiff enough.

A still further object of this invention is to provide an improved method for producing the above-mentioned coated synthetic paper.

Other objects and advantages of the invention will become apparent from the following detailed description of the invention.

SUMMARY OF THE INVENTION

The above mentioned objects of the invention can be achieved by forming on a polyolefinic synthetic paper a coating layer which is formed of a pigment component and an adhesive component, a part of said pigment component being an organic polymer pigment in the form of finely divided particles. More definitely, the coated synthetic paper adapted for offset printing according to the invention comprises a base paper sheet comprising fibrous material, at least 5% by weight of which is formed of polyolefinic pulp, and a coating layer formed on at least one of the surface of said base paper sheet, said coating layer being substantially formed of an adhesive component and a pigment component, at least a part of said pigment component being an organic polymer pigment in the form of finely divided particles.

We have found that the offset printability of the synthetic paper formed of polyolefinic pulp is unexpectedly and remarkably improved by forming a coating layer on the synthetic paper with use of a coating composition including finely divided particles of organic polymers. Accordingly, this invention is characterized in a combination of a polyolefinic synthetic paper with a coating composition including specified organic polymer particles.

Preferably, 5 to 95% by weight of fibrous material in the base paper sheet is formed of polyolefinic pulp. The remaining portion of the fibrous material may be natural cellulose pulp.

At least 5%, more preferably, at least 10% by weight on dry basis of the pigment component may be an organic polymer pigment in the form of finely divided particles. The pigment component may consist of a mixture of an organic polymer pigment in the form of finely divided particles and an inorganic pigment.

The amount of the adhesive component in the coating layer may be 5 to 100 parts by weight, more preferably, 8 to 35 parts by weight with respect to 100 parts by weight on dry basis of the pigment component included in the coating layer.

Preferably, the organic polymer pigment used in the invention is formed of finely divided particles of an organic polymer having a deflection temperature higher than 30° C, more preferably higher than 50° C. according to the ASTM Standard D648. The organic polymer pigment may preferably consist of finely divided particles having an average size of 0.1 to 1.0 micron.

In a preferred embodiment of the invention said organic polymer pigment consists of finely divided particles of a member selected from the group consisting of polystyrene, polymethyl methacrylate and copolymers of the foregoing with any vinyl monomer.

The amount of the coating composition including the above mentioned organic polymer pigment should be at least 0.5 g/m², preferably 3.0 to 30 g/m² on dry basis.

The polyolefinic pulp used in the invention may be formed of fibrils and has a specific surface area of at least 0.7 m²/g. The polyolefinic pulp may be formed of a polyolefinic polymer and a hydrophilic polymer.

DETAILED DESCRIPTION OF THE INVENTION

A part of the fibrous material of the base paper sheet of the coated synthetic paper according to the invention is formed of polyolefinic pulp containing a hydrophilic component. Among polyolefins for the polyolefinic pulp there are included homopolymers obtained by polymerization of olefin monomers such as ethylene, propylene, 4-methylpentene-1, butene-1, styrene and copolymers of these olefins. Copolymers obtained by polymerization of these olefins with copolymerizable vinyl monomers, such as ethylene-vinyl acetate copolymer and ethylene-acrylic acid salt copolymer, are also included thereamong.

As examples of the hydrophilic component there are included polymers having a hydroxyl group such as polyvinyl alcohol, saponified ethylene-vinyl acetate copolymer, polyvinyl alcohol to which a vinyl monomer such as styrene or methyl methacrylate is radically graft-polymerized; polymers and copolymers obtained by polymerization of monomers having carboxyl group such as acrylic acid, methacrylic acid, butene-tri-carboxylic acid, maleic anhydride, itaconic acid, and their partial esters; polymers having amide group such as polyacrylamide; and other hydrophilic polymers such as polyethylene oxide and carboxymethyl cellulose. These hydrophilic components may be incorporated into polyolefins by polymer-blending and/or graft-copolymerization. The composition ratio by weight between a hydrophilic component and a polyolefin in the fibrous material is preferably within the range of 0.100 to 40:60, more preferably of 1:99 to 30:70. Any conventional heat-stabilizer, antioxidant and ultraviolet absorber may be added to a polyolefinic composition for preparing the polyolefinic pulp. Inorganic powder such as silica, alumina, talc, calcium carbonate, calcium sulfite and calcium sulfate may also be added thereto as a filler. The polyolefinic fibrous material may be obtained through the utilization of the techniques of emulsion flush spinning, flush spinning, solution shearing, uniaxial stretching and splitting, melt spinning and so on. Among these techniques the emulsion flush spinning method, the flush spinning method and the solution shearing method are preferable and the emulsion flush spinning method is most preferable.

The emulsion flush spinning technique is, per se, known, for example, as disclosed in U.S. Pat. No. 3,808,091. According to the emulsion flush spinning technique, the fibrous material for pulp is produced by the steps of admixing a polyolefin, a solvent for the polyolefin and a non-solvent to prepare an admixture, heating the admixture under strong agitation to prepare a heated emulsion in which the polyolefin is dissolved, and ejecting the heated emulsion under high pressure through an orifice. For example polyethylene as a polyolefin, hexane as a solvent, sodium lauryl benzene sulfonate as a surface active agent and water containing polyvinyl alcohol as a dispersion medium or a nonsolvent are used. The synthetic pulp, which is obtained by disintegrating the ejected fibrous material, has a large specific surface area and includes a hydrophilic polymer and a surface active agent therein. The synthetic pulp thus obtained can be suspended well in water and has a good self-bonding property.

In the flush spinning method a polyolefin dissolved in an organic solvent is ejected through an orifice at a high temperature and under high pressure. In this method ejected fibrous material can hardly include any hydrophilic polymer and accordingly it is necessary to treat it with a hydrophilic polymer and a surface active agent during or after disintegrating in order to provide the obtained fibrous material with a hydrophilic property. This flush spinning method, per se, is also known, for example, as disclosed in U.S. Pat. No. 3,081,519.

The solution shearing method is, per se, known as disclosed in German Pat. No. 2,058,396 and British Pat No. 868,651. For example, a polymer solution is added to a non-solvent for the polymer to separate the polymer and a shearing force is applied to the polymer which is being separated to produce fibrous material. It is also possible to produce fibrous material by applying a shearing force to the polymer which is being separated in the stage of polymerization of an olefin. The fibrous material thus obtained by the solution shearing method is then subjected to the step to provide it with a hydrophilic property as in the case of the flush spinning technique.

Some hydrophilic components such as polyvinyl alcohol, saponified ethylene-vinyl acetate copolymer, polyethylene oxide, polyacryl amide and modified starch may be added to the fibrous material obtained by any of the above-mentioned methods, after disintegrating treatment, so as to make it easily dispersible in water and to give it good self-bonding ability.

Generally, polyolefinic synthetic pulp has a complexed fine structure of micro-fibril or micro-membrane.

The specific surface area of the synthetic pulp may preferably be more than 0.7 m²/g, most preferably more than 1.0 m²/g, being measured according to the BET method.

If the specific surface area of the synthetic pulp is less than 0.7 m²/g, the aforementioned objects of the invention cannot be achieved.

The polyolefinic synthetic pulp thus prepared can be made into paper sheets by itself alone or with cellulose pulp by a conventional paper machine. At least 5% by weight of the fibrous material of the paper sheet should be formed of the polyolefinic synthetic pulp. In the event that the polyolefinic synthetic pulp is contained in the paper sheet in an amount less than 5% by weight the aforementioned various advantages due to use of polyolefinic pulp cannot be obtained.

Most preferably the paper sheet is formed of a mixture of polyolefinic pulp with natural cellulose pulp, though it may be formed of a mixture of a polyolefinic pulp with any other synthetic pulp. In case of the paper sheet formed of a mixture of polyolefinic pulp with natural cellulose pulp, the composition ratio by weight therebetween may preferably be within the range of 5:95 to 95:5.

In the stage of making the paper, conventional fillers, sizing agents and dyes may also be added without sacrificing the advantages of the invention.

A useful coating composition for this invention is an aqueous composition consisting essentially of a pigment component and an adhesive component. At least a part of the pigment component contains finely divided particles of an organic polymer.

Finely divided particles of an organic polymer are preferably of spherical and/or spheroidal forms, although they may be shaped in any other form. The particles may have an average particle size of 0.1 to 1.0 micron. It is required that those particles may not form a film under the conditions for applying and drying the coating composition and for finishing the coated paper. Preferably the organic polymer particles have a deflection temperature of at least 30° C, most preferably at least 50° C, defined and measured according to the ASTM Standard D-648.

These particles described may be prepared by emulsion polymerization of a suitable monomer or a mixture of such monomers or by emulsifying a suitable polymer produced by another method such as bulk or solution polymerization. Any conventional pulverizing technique may then be applied to prepare finely divided particles.

Among the suitable organic materials for the finely divided particles there are included polymonovinylidene aromatics such as polystyrene, poly($\alpha$-methylstyrene), poly(4-ethylstyrene), poly(1-vinylnaphthalene), etc.; polyolefins and polyhaloolefins such as polyvinyl chloride, poly(hexafluoropropylene), polyethylene, polypropylene, poly(1-butene), poly(4-methyl-1-pentene), polyvinylidene chloride, poly(1,2-difluoroethylene), esters of $\alpha,\beta$-ethylenically unsaturated acids such as polymethacrylates, polychloroacrylates, and polychloromethacrylates, e.g., poly(methyl methacrylate), poly(isopropyl chloroacrylate), poly(2-chloroethyl methacrylate), poly(cyclohexyl chloroacrylate), poly(methyl chloroacrylate), polyvinyl acetate, polyallyl acetate, polyvinyl propionate, etc.; and other polymers such as poly(ethylene-1,5-naphthalate), polyethylene terephthalate; poly(hexamethylene adipamide), poly($\epsilon$-capramide), poly(decamethylene adipamide), polycarbonates polyacetals, polyvinyl formal, polyvinyl butyral, etc. Copolymers of the constituent monomers of the above-named polymers such as ethylene-vinylacetate copolymer, ethylene-propylene copolymer, etc. are also suitable.

Various other copolymerizable monomers such as conjugated diethylenically unsaturated monomers, alkyl acrylates and acrylonitrile may be present in a small amount as comonomers in the afore-mentioned suitable polymers. Typical examples of such conjugated diethylenically unsaturated monomers are 1,3-butadiene, isoprene, 2-chloro-1,3-butadiene and divinylbenzene. Typical examples of such alkyl acrylates are methyl acrylate, ethyl acrylate, n-propyl acrylate, sec-butyl acrylate and n-butyl acrylate. $\alpha,\beta$-ethylenically unsaturated carboxylic acids and anhydrides thereof such as acrylic acid, methacrylic acid, maleic acid, itaconic acid, fumaric acid and maleic anhydride may also be used as copolymerized constituents of the suitable polymers. For example, such copolymers as ethylene-acrylic acid copolymer, ethylene-maleic anhydride copolymer, styrene-maleic anhydride copolymer, etc. are also suitable polymers in this invention.

Among the above mentioned organic polymers, vinyl polymers and vinyl copolymers are preferably used for carrying out the invention.

The useful coating composition for this invention is an aqueous coating composition which may be prepared by dispersing the above-mentioned organic polymer particles alone or with proper inorganic pigments in an aqueous solvent containing an adhesive material, or by mixing an organic polymer emulsion and an adhesive material with an aqueous solvent containing or not containing an inorganic pigment. Useful adhesives for the above coating composition are natural and synthetic adhesives conventionally used for preparing known aqueous pigment coating compositions. For examples there may be mentioned proteins such as casein, soybean protein, gelatin, etc.; starchs or derivatives thereof such as dextrin, raw starch, oxidized starch, esterified starch, etherified starch, cationic starch, phosphated starch, etc.; cellulose derivatives such as carboxymethyl cellulose, hydroxyethyl cellulose, etc.; conjugated diene polymer latexes such as styrene butadiene copolymer, methyl methacrylate-butadiene copolymer, etc.; acrylic polymer latexes such as polymers or copolymers of acrylic esters and/or methacrylic esters, etc.; vinyl polymer latexes such as ethylene vinyl acetate copolymer, etc.; polymer latexes modified by functional groups such as carboxyl group etc.; synthetic resin adhesives such as polyvinyl alcohol, olefin maleic anhydride copolymer, melamine resin, etc. These adhesives may also be used in the form of a mixture.

Inorganic pigments which can be mixed with finely divided particles of an organic polymer may be kaolin, clay, calcium carbonate, calcium silicate, calcium sulfate, calcium sulfite, titanium oxide, aluminium hydroxide, barium sulfate, zinc oxide, satin white, talc, colloidal silica, etc. The preferable mixing ratio of the organic polymer particles with inorganic pigments is within the range of 100:0–5:95 solid by weight. If the amount of inorganic pigments mixed is over the above range, the desirable effects for this invention cannot be obtained. More preferably, the mixing ratio is within the range of 100:0–10:90 solid by weight. As different adhesives show different adhesions, the amount thereof to be used is not standardized. The amount thereof is usually within the range of 5–100 parts by weight, preferably, 8–35 parts by weight with respect to 100 parts of pigments (including organic polymer particles). The thus obtained coating composition may, of course, contain additives such as dispersing agent, insolubilizer, preservative, flow modifier, dyestuff, foam control agent, etc. The above-mentioned coating composition is applied onto the base paper formed of polyolefinic synthetic pulp by on-machine coater or off-machine coater having proper coating devices such as blade coater, air-knife coater, roll coater, brush coater, curtain coater, champflex coater, bar coater, gravure coater, spray coater, size-press coater or the like, and is thereafter dried. High temperatures should be avoided when drying the coated paper, to avoid melting the organic polymer particles and causing them to form a continuous film.

The amount of the coating composition to be applied depends on the components thereof or the grade of the paper, and therefore is not standardized. To improve the printability for offset printing, however, the effective amount thereof is at least 0.5 g/m$^2$, preferably 3 – 30 g/m$^2$, on the basis of dry weight per one side of the paper. The desirable effects owing to the invention cannot be obtained if the coating composition is applied in such an amount as less than 0.5 g/m$^2$. The upper limit of the coating amount of 30 g/m$^2$ is restricted only in economical view. The coating layer may be formed by one-time application of a coating composition and also by twice or more applications of the same or with another coating composition.

The thus obtained coated synthetic paper can be subjected to treatments by calender, gloss calender and super calender as well as the finishing treatments for the conventional coating. In carrying out these treatments, such a high temperature and/or such a high pressure as may cause the polymer particles to deform and form a continuous film should not be adopted.

The theory of the improvement of the offset printability according to the invention is not yet known. Our proposed theory is such that if a coating composition containing organic polymer particles is coated onto the surface of the synthetic paper described, the organic polymer particles migrate toward the surface of the coating layer with the result of forming a microporous and discontinuous coating layer which is prepared to effectively absorb the fountain solution when applied.

The coated synthetic paper according to this invention is greatly advantageous in that it has not only a good printability for offset printing but also a high brightness and a high opacity, a good water resistance, and a good dimensional stability and in that a light weight coated paper can be produced without sacrificing the desirable properties of polyolefinic fiber paper.

PREFERRED EMBODIMENTS OF THE INVENTION

Now the present invention will be explained more in detail, referring to Examples, but these Examples are merely illustrative, but not limitative of the present invention. In the Examples, parts and percentage representing proportions are parts by weight and percentage by weight, respectively, unless otherwise specified.

EXAMPLES 1 - 5

100 parts of polypropylene ($[\eta] = 1.3$ dl/g) and 1070 parts of methylene chloride were mixed to form a slurry. Then, 1200 parts of polyvinyl alcohol aqueous solution containing therein 10 parts of polyvinyl alcohol (polymerization degree: 1400, saponification value: 99%) and 2 parts of dodecylbenzene sulfonate were added to the slurry. This mixture was put into an autoclave and then heated with stirring to obtain an emulsion. When the temperature of the emulsion was elevated up to 140° C, it was ejected through a nozzle to obtain fibrous material. The obtained fibrous material was made into a 1% aqueous suspension, which was in turn refined by SPROUT WALDRON disk refiner. The specific surface area of the obtained synthetic pulp was 15 $m^2/g$. The thus obtained synthetic pulp and a natural cellulose pulp mixture consisting of 20 parts of NBKP (bleached softwood kraft pulp, CSF 420cc) and 80 parts of LBKP (bleached hardwood kraft pulp, CSF 400 cc) were mixed together in various ratios as given in Table 1. Thereafter, 0.5 parts of rosin with respect to 100 parts of the pulp and 2.5 parts of aluminum sulfate with respect to 100 parts of the pulp were added thereto to produce a slurry having a consistency of 0.3%. A paper sheet was made by a laboratory foundrinier paper machine, and then the paper sheet was treated by means of size press with polyvinyl alcohol (polymerization degree: 1,700, saponification value: 99%) to obtain a base paper of 40 $g/m^2$.

Separately, 32.4 parts of No. 1 grade kaolin, 25.2 parts of No. 2 grade kaolin, 14.4 parts of aluminum hydroxide and 28 parts (solids) of polystyrene emulsion (a deflection temperature: 94° C at 18.5 $kg/cm^2$ and an average particle size: 0.5 micron) were dispersed into water with enough stirring by a high speed mixer to form a slurry having a 67% solid content. To this slurry, 7 parts (solids) of oxidized starch solution (oxidization degree: 0.013) 16 parts (solids) of carboxylated styrene-butadiene copolymer latex (styrene/butadiene: 60/40) were added to produce a coating composition having a final concentration of 58%. The thus obtained coating composition was applied onto the above base paper in amounts of 7 $g/m^2$ (felt side), 9 $g/m^2$ (wire side), respectively on dry basis by a blade coater. Then the coated paper was dried and super-calendered. The various properties of the obtained coated papers are shown in Table 1.

CONTROL 1

100 parts of the same natural cellulose pulp mixture as used in Examples 1 - 5, 0.5 parts of rosin and 2.5 parts of aluminum sulfate were mixed together to produce a slurry having a consistency of 0.3%. A base paper of 40 $g/m^2$ was obtained in the same manner as described in Example 1.

Separately, 45 parts of No. 1 grade kaolin, 35 parts of No. 2 grade kaolin and 20 parts of aluminum hydroxide were dispersed into water with enough stirring by a high speed mixer to obtain a slurry having a solid content of 67%. To this slurry, 7 parts (solids) of oxidized starch solution (oxidization degree: 0.013) and 14 parts (solids) of styrene-butadiene latex (the same one as that used in Examples 1 to 5) were added to produce a coating composition having a final concentration of 58%. This coating composition was applied onto the above base paper by 7 $g/m^2$ (felt side), 9 $g/m^2$ (wire side), respectively, on dry basis by means of blade coater, and then dried and super-calendered to obtain a coated paper. The properties of this coated paper are shown in Table 1.

CONTROL 2

This control is similar to Control 1 except that the same base paper as used in Example 3 was used. The properties are also shown in Table 1.

Table 1

| | Example | | | | | Control | |
|---|---|---|---|---|---|---|---|
| | 1 | 2 | 3 | 4 | 5 | 1 | 2 |
| Mixing Ratio of Pulp (%) | | | | | | | |
| NBKP | 19 | 16 | 13 | 10 | 0 | 20 | 13 |
| LBKP | 76 | 64 | 52 | 40 | 0 | 80 | 52 |
| Polyolefin Pulp | 5 | 20 | 35 | 50 | 100 | 0 | 35 |
| Properties of Coated Paper | | | | | | | |
| Density($g/cm^3$) | 1.09 | 1.05 | 1.00 | 0.93 | 0.83 | 1.13 | 1.05 |
| Brightness(%) | 78.9 | 79.5 | 83.5 | 85.6 | 89.8 | 76.6 | 82.1 |
| Opacity(%) | 80.4 | 83.8 | 87.1 | 90.8 | 95.3 | 78.8 | 85.6 |
| Gloss(%) | 56.0 | 55.8 | 52.3 | 50.4 | 49.5 | 40.6 | 36.5 |
| Water Resistance | B | A | A | A | A | D | C |
| Printability for Offset Printing | A | A | A | A | B | B | D |

(Note 1) Methods for evaluation of the quality of paper:
(1) Brightness: Determined according to JIS P8123 (the larger the value, the higher the brightness).
(2) Opacity: Determined according to JIS P8138 (the larger the value, the more opaque).
(3) Gloss: Determined with 75° Specular Glossmeter (the larger the value, the higher the gloss).
(4) Water Resistance: Two drops of water were dropped on the coated surface, which was rubbed with a finger 15 times. Then, the water droplets were transferred on a surface of a black glass plate. After drying, the degree of whiteness on the plate was observed.
(5) Offset Printability: The test of offset printability was carried out with use of RI Printability Tester (manufactured by AKIRA Industry Co.) with two printing units, one of which was for applying a fountain solution, another was for applying a printing ink. The ink receptivity of the paper was observed.
(Note 2) Evaluation of each water resistance and offset printability:
A: Excellent
B: Good
C: Poor
D: Very poor The above notes are also applicable to Tables 2 to 5 as well.

As compared with Control 1, the coated papers obtained in Examples 1 to 5 were each of excellent brightness, opacity, gloss and water resistance. Furthermore, the coated paper of the invention had an excellent offset printability.

To the contrary, the coated paper obtained in Control 2 had a very poor offset printability.

In the following Examples 6 to 8 the coated papers were produced in the same manner as described in Example 3 except that different synthetic pulps were used, respectively.

EXAMPLE 6

A mixture composed of 95 parts of high density polyethylene (Melt Index by ASTM D1238 : 6.0 g/10 min.) as a polyolefin, 5 parts of polyvinyl alcohol (polymerization degree: 1400 and saponification value: 99% ) as hydrophilic polymer, 900 parts of hexane as a solvent and 3 parts of sodium dodecylbenzene sulfonate as a surface active agent, was emulsified under the same conditions as in Example 1.

The emulsified dispersion obtained was ejected through a nozzle to produce a fibrous material. The synthetic pulp obtained after refining by SPROUT WALDRON disk refiner, had a specific surface area of 15.9 $m^2/g$ by BET method.

EXAMPLE 7

A mixture composed of 75 parts of polypropylene ($[\eta]$ = 2.3 dl/g, MI = 1.5 g/10 min.), 5 parts of polyacrylamide, 20 parts of ethylene vinylacetate copolymer (polymerization degree = 2000 and ethylene/vinylacetate : 85/15) and 30 parts of calcium carbonate powder, was emulsified under the same conditions as described in Example 1. The resulted dispersion was ejected through a nozzle in order to produce a fibrous material. The specific surface area of the refined pulp was 21.5 $m^2/g$ by BET method.

EXAMPLE 8

A mixture composed of 77 parts of high density polyethylene (MI = 0.3 g/10 min.) and 18 parts of ethylene sodium acrylate copolymer (MI = 5 g/10 min. ethylene/sodium acrylate : 90/10) as polyolefins, 5 parts of polyethylene oxide (polymerization degree : 100,000) as a hydrophilic polymer, 900 parts of hexane as a solvent and 4 parts of sodium lauryl benzene sulfonate, was emulsified under the same conditions as described in Example 1. The emulsified dispersion obtained was ejected through a nozzle in order to prepare a fibrous material. Synthetic polyolefinic pulp after refining had a specific surface area of 18.9 $m^2/g$ by BET method.

CONTROLS 3 TO 5

In Controls 3 to 5, the same base papers as used in Examples 6 to 8 were used respectively. The other conditions were the same as described in Control 1.

The various properties of the coated papers prepared by Examples 6 to 8 and Controls 3 to 5 are shown in Table 2.

Table 2

| | Example | | | Control | | |
|---|---|---|---|---|---|---|
| | 6 | 7 | 8 | 3 | 4 | 5 |
| Mixing Ratio of Pulp (%) | | | | | | |
| NBKP (%) | 13 | 13 | 13 | 13 | 13 | 13 |
| LBKP (%) | 52 | 52 | 52 | 52 | 52 | 52 |
| Polyolefinic Pulp (%) | 35 | 35 | 35 | 35 | 35 | 35 |
| Properties of Coated Paper | | | | | | |
| Density ($g/cm^3$) | 1.01 | 1.03 | 1.00 | 1.07 | 1.09 | 1.05 |

Table 2-continued

| | Example | | | Control | | |
|---|---|---|---|---|---|---|
| | 6 | 7 | 8 | 3 | 4 | 5 |
| Brightness (%) | 84.2 | 83.8 | 84.6 | 83.0 | 82.6 | 83.0 |
| Opacity (%) | 85.4 | 88.6 | 87.4 | 84.0 | 87.2 | 85.6 |
| Gloss (%) | 50.3 | 49.7 | 51.2 | 35.1 | 33.4 | 35.8 |
| Water Resistance | A | A | A | c | c | c |
| Printability for Offset Printing | A | A | A | c | c | c |

Table 2 indicates the fact that the coated papers obtained by Examples 6 to 8 were superior in each of the gloss, the water resistance and the offset printability in comparison with those prepared according to Controls 3 to 5. Particularly, the offset printability of the coated papers prepared by Controls 3 to 5 were remarkably bad.

Other examples utilizing polyolefinic synthetic pulps prepared according to another methods are given hereinbelow as Examples 9 and 10.

EXAMPLE 9

A polyolefin synthetic pulp was prepared through the utilization of the solution shearing method. 5 parts of high density polyethylene (MI = 0.3 g/10 min.) was dissolved into 95 parts xylene at a temperature above 100° C to obtain a 5% xylene solution which was then poured gradually into cold ethanol which was a non-solvent of polyethylene under a high shearing force with vigorous agitation of a juicer mixer. Pulp-like material obtained was treated by the same polyvinyl alcohol as used in Example 1 and refined by SPROUT WALDRON disk refiner. The specific surface area of the pulp was 6.3 $m^2/g$ by BET method.

35 parts of the thus obtained synthetic pulp was admixed together with a natural cellulose pulp mixture consisting of 13 parts of NBKP and 52 parts of LBKP to prepare a base paper in a similar manner to that described in Examples 1 to 5.

Then a coating composition containing organic polymer particles was applied to the base sheet. The coating composition was the same as that used in Examples 1 to 5 and the coating technique was also the same as described in Examples 1 to 5.

EXAMPLE 10

Polyolefin synthetic pulp was prepared by the solution flush-spinning method. A solution obtained by dissolving 100g of high density polyethylene (MI = 6.0 g/10 min.) into 1 l of hexane under vigorous agitation at a temperature of 180° C was flushed through a nozzle. Obtained endless fibrous material was cut into about 5 mm length and refined by a refiner of SPROUT WALDRON disk refiner adding thereto polyvinyl alcohol (the same as in Example 1) and sodium dodecylbenzene sulfonate. The specific surface area of the pulp was 16.7 $m^2/g$ by BET method.

A coated synthetic paper was produced in a similar manner to that described in Examples 1 to 5. The other conditions were the same as described in Example 9.

CONTROL 6

A coated synthetic paper was produced utilizing a base paper which was the same as used in Example 9 with a coating composition which was the same as used in Control 1. The other conditions were the same as described in Example 9.

CONTROL 7

A coated synthetic paper was produced utilizing a base paper which was the same as used in Example 10 with a coating composition which was the same as used in Control 1. The other conditions were the same as described in Example 10.

The various properties of the coated synthetic papers obtained by Examples 9 and 10 and Controls 6 and 7 are indicated in Table 3. It will be observed from Table 3 that the coated paper obtained in each of Examples 9 and 10 was much superior to that obtained in each of Controls 6 and 7 with respect to each of the gloss, the water resistance and the offset printability.

Table 3

| | Example | | Control | |
|---|---|---|---|---|
| | 9 | 10 | 6 | 7 |
| Mixing Ratio of Pulp (%) | | | | |
| NBKP (%) | 13 | 13 | 13 | 13 |
| LBKP (%) | 52 | 52 | 52 | 52 |
| Polyolefin Pulp (%) | 35 | 35 | 35 | 35 |
| Properties of Coated Paper | | | | |
| Coated Weight ($g/m^2$) F/W | 7/9 | 7/9 | 9/11 | 9/11 |
| Paper Weight ($g/m^2$) | 56 | 56 | 60 | 60 |
| Density ($g/cm^3$) | 0.95 | 0.98 | 1.01 | 1.02 |
| Brightness (%) | 84.5 | 84.2 | 83.8 | 83.4 |
| Opacity (%) | 83.1 | 85.6 | 82.6 | 85.0 |
| Gloss (%) | 50.6 | 48.7 | 35.3 | 33.1 |
| Water Resistance | A | A | D | D |
| Printability for Offset Printing | A | A | D | C |

EXAMPLES 11 TO 14

The base paper in each of Examples 11 to 14 was the same as that of Example 3. Four kinds of coating compositions containing polystyrene emulsion which was the same as used in Example 1 were prepared and coated on the base paper to obtain coated synthetic paper. The composition ratios of the coating compositions were as indicated by weight solid in Table 4, respectively.

CONTROL 8

The base paper was the same as that in Example 3. A coating composition containing no polystyrene emulsion was applied to the base paper to obtain a coated synthetic paper. The composition ratio of the coating composition was as indicated by weight solid in Table 4.

Various properties of the coated synthetic papers obtained in Examples 11 to 14 were indicated in Table 4 together with those of Control 8.

Table 4

| | Control | Example | | | |
|---|---|---|---|---|---|
| | 8 | 11 | 12 | 13 | 14 |
| Formulation (parts by weight) | | | | | |
| No. 1 Grade Kaolin | 45 | 42.7 | 36.0 | 22.5 | 0 |
| No.2 Grade Kaolin | 34 | 32.3 | 27.2 | 17.0 | 0 |
| Aluminum hydroxide | 21 | 20.0 | 16.8 | 10.5 | 0 |
| Polystyrene | 0 | 5 | 20 | 50 | 100 |
| Oxidized starch | 7 | 7 | 7 | 7 | 7 |
| Styrene butadiene latex | 14 | 15 | 16 | 19 | 24 |
| Properties of Coated Paper | | | | | |
| Coated Weight ($g/m^2$) F/W | 9/11 | 8/10 | 7.5/9.5 | 5/6 | 3.5/4.3 |
| Paper Weight ($g/m^2$) | 60 | 58 | 57 | 51 | 47.8 |
| Density ($g/cm^3$) | 1.05 | 1.03 | 1.01 | 0.92 | 0.85 |
| Brightness (%) | 82.3 | 82.9 | 83.3 | 84.1 | 84.6 |
| Opacity (%) | 86.1 | 86.5 | 86.8 | 87.0 | 87.2 |
| Gloss (%) | 38.4 | 45.5 | 51.1 | 52.6 | 52.5 |
| Water Resistance | D | B | A | A | A |
| Printability for Offset Printing | D | B | A | A | A |

As seen from Table 4, as compared with Control 8, the coated synthetic paper obtained in each of Examples 11 to 14 had an excellent offset printability and showed a good ink receptivity. It was also observed that in Examples 11 to 14 various physical and chemical characteristics were remarkably improved and those improvements depended on the amount of polystylene used. The improved offset printability was obtained with a relatively small amount of the coating composition containing polystylene. This means that according to the invention the weight of the coated synthetic paper can be reduced without sacrificing other properties desired.

EXAMPLES 15 to 29

The base sheet is the same as that of Example 12. Various coating compositions including different organic polymers as indicated in Table 5 are applied to the base sheet to obtain coated papers. The other conditions are the same as those in Example 12. The offset printability of each of the coated papers obtained in those examples is indicated in Table 5. In these examples, coated papers having an improved offset printability were obtained.

Table 5

| Ex. | Organic Polymer | Deflection Temperature | Average Particle Size ($\mu$) | Printability for Offset Printing |
|---|---|---|---|---|
| 15 | Polyvinyl chloride | 64 | 0.4 | A |
| 16 | Polyethylene (L.D.) | 45* | 0.9 | B |
| 17 | Polypropylene | 99* | 0.8 | B |
| 18 | Ethylene propylene block copolymer (15:85) | 85* | 0.8 | B |
| 19 | Poly-4-methyl-1-pentene | 180 | 0.7 | A |
| 20 | Polymethyl acrylate | 97 | 0.4 | A |
| 21 | Polyvinyl acetate | 38 | 0.5 | B |
| 22 | Ethylene . vinyl acetate copolymer (92:8) | 40* | 0.5 | B |
| 23 | Ethylene . propylene random copolymer (3:97) | 65* | 0.5 | B |
| 24 | Styrene . acrylonitrile copolymer (76:24) | 92 | 0.3 | A |
| 25 | Styrene . maleic anhydride copolymer (1:1)(molar ratio) | 140 | 0.3 | A |
| 26 | Ethylene . maleic anhydride copolymer (1:1)(molar ratio) | 170 | 0.5 | B |
| 27 | Sodium salt of ethylene . acrylic acid copolymer (90:10) | 88 | 0.4 | A |
| 28 | Styrene . acrylonitrile . itaconic acid copolymer (92:6:2) | 85 | 0.5 | A |
| 29 | Styrene . acrylonitrile . $\beta$-hydroxyethyl acrylate copolymer (89:6:3:2) | 80 | 0.5 | A |

Note 1 In Table 5 the composition ratios of the polymers are indicated by weight except Examples 25 and 26.

Note 2 The deflection temperatures marked with * are given as under pressure of 4.6 $kg/cm^2$ while those not marked are given as under pressure of 18.5 $kg/cm^2$ both by ASTM Standard D648.

EXAMPLE 30, CONTROL 9

In Example 30, the coated papers were obtained by applying successively the first coating layer (under coating layer) and second coating layer (upper coating layer) each comprising various components as shown in Table 6 to the same base paper as that in Example 3. In Control 9 the second coating layer includes no polystyrene emulsion. The amount of each component of coating composition is indicated by weight solid. The properties of the obtained coated paper were also shown in Table 6.

Table 6

| | Example 30 | Control 9 |
|---|---|---|
| The first coating layer | | |
| No. 2 Grade Kaolin | 75 | 75 |
| Calcium carbonate | 25 | 25 |
| Sodium hexamethaphosphate | 0.3 | 0.3 |
| Oxidized starch | 15 | 15 |
| Styrene butadiene latex | 4 | 4 |
| The second coating layer | | |
| No. 1 Grade Kaolin | 32.4 | 45 |
| No. 2 Grade Kaolin | 24.5 | 34 |
| Aluminum hydroxide | 15.1 | 21 |
| Polystyrene | 28 | 0 |
| Oxidized starch | 7 | 7 |
| Styrene butadiene latex | 16 | 14 |
| Coated weight (g/m²) | | |
| The first coating layer F/W | 6/8 | 6/8 |
| The second coating layer F/W | 3/5 | 3/5 |
| Paper weight (g/m²) | 62 | 62 |
| Density (g/cm³) | 1.03 | 1.08 |
| Brightness (%) | 81.8 | 81.1 |
| Opacity (%) | 86.8 | 86.0 |
| Gloss (%) | 58.3 | 42.5 |
| Water resistance | A | D |
| Printability for offset printing | A | C |

What we claim is:

1. A coated synthetic paper adapted for offset printing comprising a base paper sheet comprising fibrous material at least 5% by weight of which is formed of polyolefinic pulp fibrils which are formed from a polyolefinic polymer and a hydrophilic polymer, said polyolefinic pulp fibrils having a specific surface area of at least 0.7 m²/g., and a microporous and discontinuous coating layer formed on at least one of the surfaces of said base paper sheet, said coating layer being substantially formed of 5 to 100 parts by weight on a dry weight basis of an adhesive component and 100 parts by weight on a dry weight basis of a pigment component, at least 5% by weight on a dry weight basis of said pigment component being an organic polymer pigment in the form of finely divided particles selected from the group consisting of polystyrene, polymethyl methacrylate and vinyl copolymers thereof.

2. A coated synthetic paper adapted for offset printing as defined in claim 1, in which 5 to 95% by weight of said fibrous material is formed of polyolefinic pulp fibrils.

3. A coated synthetic paper adapted for offset printing as defined in claim 1, in which said fibrous material is formed of a mixture of 5 to 95% by weight of polyolefinic pulp fibrils and 95 to 5% by weight of a natural cellulose pulp.

4. A coated synthetic paper adapted for offset printing as defined in claim 1, in which at least 10% by weight on dry basis of said pigment component is an organic polymer pigment in the form of finely divided particles.

5. A coated synthetic paper adapted for offset printing as defined in claim 1, in which said pigment component consists of a mixture of an organic polymer pigment in the form of finely divided particles and an inorganic pigment.

6. A coated synthetic paper adapted for offset printing as defined in claim 1, in which the amount of said adhesive component is 8 to 35 parts by weight with respect to 100 parts by weight on dry basis of said pigment component.

7. A coated synthetic paper adapted for offset printing as defined in claim 1, in which said organic polymer pigment comprises finely divided particles of an organic polymer having a deflection temperature higher than 30° C according to the ASTM Standard D-648.

8. A coated synthetic paper adapted for offset printing as defined in claim 1, in which said organic polymer pigment comprises finely divided particles of an organic polymer having a deflection temperature higher than 50° C according to the ASTM Standard D-648.

9. A coated synthetic paper adapted for offset printing as defined in claim 1, in which said organic polymer pigment consists of finely divided particles having an average size of 0.1 to 1.0 micron.

10. A coated synthetic paper adapted for offset printing as defined in claim 1 in which the weight of said coating layer is at least 0.5 g/square meter on dry basis.

11. A coated synthetic paper adapted for offset printing as defined in claim 1, in which the weigth of said coating layer is 3.0 to 30 g/square meter on dry basis.

12. A method for the production of a coated synthetic paper adapted for offset printing, comprising:

preparing a base paper sheet comprising fibrous material, at least 5% by weight of which is formed of polyolefinic pulp fibrils which are formed from a polyolefinic polymer and a hydrophilic polymer, said polyolefinic pulp fibrils having a specific surface area of at least 0.7 square meter/g., and forming a microporous and discontinuous coating layer on at least one of the surfaces of said base paper sheet with a coating composition consisting essentially of 5 to 100 parts by weight on a dry weight basis of an adhesive component and 100 parts by weight on a dry weight basis of a pigment component, at least 5% by weight on a dry weight basis of said pigment component being an organic polymer pigment in the form of finely divided particles selected from the group consisting of polystyrene, polymethyl methacrylate and vinyl copolymers thereof.

13. A coated synthetic paper adapted for offset printing, comprising:

a base paper sheet comprising fibrous material, at least 5% up to 95% by weight of which is formed of polymeric pulp fibrils and 95% to 5% by weight of cellulose pulp, said polymeric pulp fibrils being formed of a hydrophilic component and a polyolefinic polymer in a weight ratio range of 1:99 to 30:70, said polymeric pulp fibrils having a specific surface area of at least 0.7 square meter/g. and a microporous and discontinuous coating layer formed on at least one of the surfaces of the base paper sheet, the coating layer consisting essentially of 5 to 100 parts by weight on a dry weight basis of an adhesive component and 100 parts by weight on a dry weight basis of a pigment component, from 5 to 100% by weight on a dry weight basis of said pigment component being an organic polymer pigment in the form of finely divided particles and selected from the group consisting of polystyrene, polymethyl methacrylate and vinyl copolymers thereof and from 0 to 95% by weight inorganic pigment.

14. A method for preparing a coated synthetic paper adapted for offset printing comprising preparing a base paper sheet comprising fibrous material, at least 5% up to 95% by weight of which is formed of polymeric pulp fibrils, the balance being cellulose pulp, said polymeric pulp fibrils being formed of a hydrophilic component and a polyolefinic polymer in a weight ratio range of 1:99 to 30:70, said polymeric pulp fibrils having a specific surface area of at least 0.7 square meter/g., and applying to at least one surface of said base paper sheet from 015 to 30 grams per square meter of a microporous and discontinuous coating layer, the coating layer consisting essentially of:

5 to 100 parts by weight on a dry weight basis of an adhesive component and 100 parts by weight on a dry weight basis of a pigment component, from 5 to 100% by weight on a dry weight basis of said pigment component being an organic polymer pigment in the form of finely divided particles and selected from the group consisting of polystyrene, polymethyl methacrylate and vinyl copolymers thereof and from 0 to 95% by weight inorganic pigment.

15. A coated synthetic paper adapted for offset printing comprising a base paper sheet comprising fibrous material, at least 5% by weight of which is formed of polyolefinic pulp fibrils which are formed from a polyolefinic polymer and a hydrophilic polymer, said polyolefinic pulp fibrils having a specific surface area of at least 0.7 $m^2/g$., and a microporous and discontinuous coating layer formed on at least one of the surfaces of said base paper sheet, said coating layer being substantially formed of 5 to 100 parts by weight on a dry weight basis of an adhesive component and 100 parts by weight on a dry weight basis of a pigment component, at least 5% by weight on a dry weight basis of said pigment component being an organic polymer pigment in the form of finely divided particles selected from the group consisting of polystyrene, poly(α-methylstyrene), poly(4-ethylstyrene), poly (1-vinylnaphthalene), polyvinyl chloride, poly(hexafluoropropylene), polyethylene, polypropylene, poly(1-butene), poly(4-methyl-1-pentene), polyvinylidene chloride, poly(1,2-difluoroethylene), poly (methylmethacrylate), poly(isopropyl chloroacrylate), poly (2-chloroethyl methacrylate), poly(cyclohexyl chloroacrylate), poly(methyl chloroacrylate), polyvinyl acetate, polyallyl acetate, polyvinyl propionate, poly(ethylene 1,5-naphthalate), polyethylene terephthalate, poly(hexamethylene adipamide), poly(ε-capramide), poly(decamethylene adipamide), polycarbonates, polyacetals, polyvinyl formal, polyvinyl butyral, and copolymers of the constituent monomers of the above-named polymers.

16. A method for the production of a coated synthetic paper adapted for offset printing, comprising:

preparing a base paper sheet comprising fibrous material, at least 5% by weight of which is formed of polyolefinic pulp fibrils, which are formed from a polyolefinic polymer and a hydrophilic polymer, said polyolefinic pulp fibrils having a specific surface area of at least 0.7 square meter/g., and forming a microporous and discontinuous coating layer on at least one of the surfaces of said base paper sheet with a coating composition consisting essentially of 5 to 100 parts by weight on a dry weight basis of an adhesive component and 100 parts by weight on a dry weight basis of pigment component, at least 5% by weight on a dry weight basis of said pigment component being an organic polymer pigment in the form of finely divided particles selected from the group consisting of polystyrene, poly(α-methylstyrene), poly(4-ethylstyrene), poly(1-vinylnaphthalene), polyvinyl chloride, poly (hexafluoropropylene), polyethylene, polypropylene, poly(1-butene), poly(4-methyl-1-pentene), polyvinylidene chloride, poly (1,2-difluoroethylene), poly(methyl methacrylate), poly(isopropyl chloroacrylate), poly(2-chloroethyl methacrylate), poly (cyclohexyl chloroacrylate), poly(methyl chloroacrylate), polyvinyl acetate, polyallyl acetate, polyvinyl propionate, poly(ethylene 1,5-naphthalate), polyethylene terephthalate, poly (hexamethylene adipamide), poly(ε-capramide), poly(decamethylene adipamide), polycarbonates, polyacetals, polyvinyl formal, polyvinyl butyral, and copolymers of the constituent monomers of the above-named polymers.

* * * * *